US007270584B1

(12) United States Patent
Mitchell

(10) Patent No.: US 7,270,584 B1
(45) Date of Patent: Sep. 18, 2007

(54) INBOARD/OUTBOARD MOTOR PROTECTOR WITH UNDERWATER HYDROFOIL

(76) Inventor: Mark Judd Mitchell, P.O. Box 16, Cowdrey, CO (US) 80434

( * ) Notice: Subject to any disclaimer, the term of this patent is extended or adjusted under 35 U.S.C. 154(b) by 0 days.

(21) Appl. No.: 11/366,703

(22) Filed: Mar. 2, 2006

(51) Int. Cl.
*B63H 5/16* (2006.01)

(52) U.S. Cl. ..... 440/71

(58) Field of Classification Search ..... 440/71
See application file for complete search history.

(56) References Cited

U.S. PATENT DOCUMENTS 3,099,240 A * 7/1963 Montague, Jr. ..... 114/281
5,178,565 A * 1/1993 Jacobson ..... 440/71
5,207,605 A * 5/1993 Kroeber ..... 440/71
5,231,950 A * 8/1993 Poulos ..... 114/274

* cited by examiner

*Primary Examiner*—Stephen Avila
(74) *Attorney, Agent, or Firm*—Avery Enterprises, Inc.; Bryce D. Avery

(57) ABSTRACT

Disclosed is a device that protects inboard/outboard motors (up to 250 horsepower) from damage and simultaneously provides an underwater hydrofoil that both helps prevent inboard/outboard motor damage and is specifically designed to improve the efficiency of an outboard motor and the speed and ride of a boat. In one embodiment, an underwater hydrofoil, skeg enclosure, skeg protector and lower-unit protector are combined into a single unit that protects the skeg, the propeller and the lower unit of an inboard/outboard motor while simultaneously improving the efficiency of an inboard/outboard motor and the speed and riding qualities of a boat using that inboard/outboard motor.

10 Claims, 3 Drawing Sheets

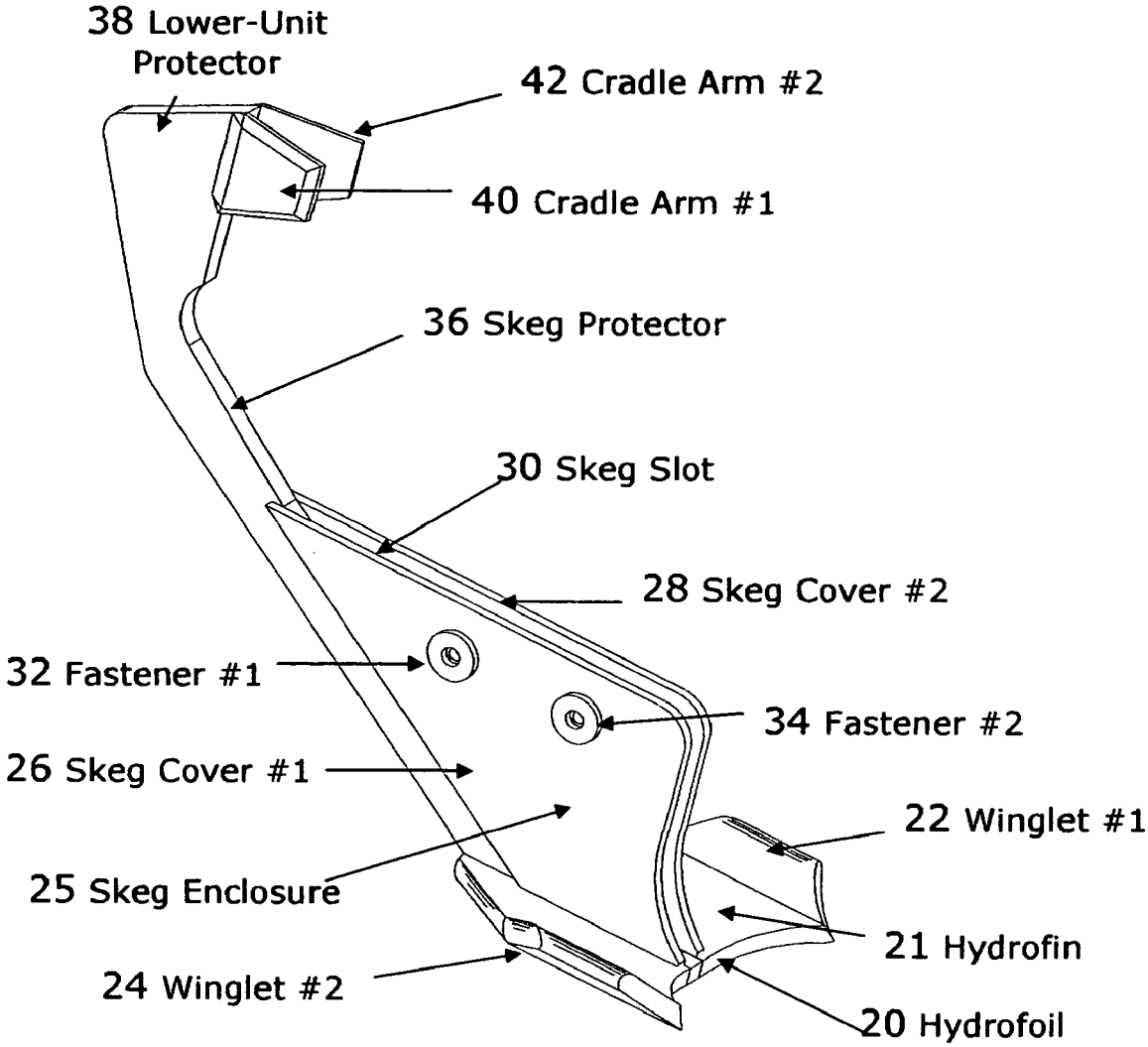
Figure 1. Perspective View of Present Invention

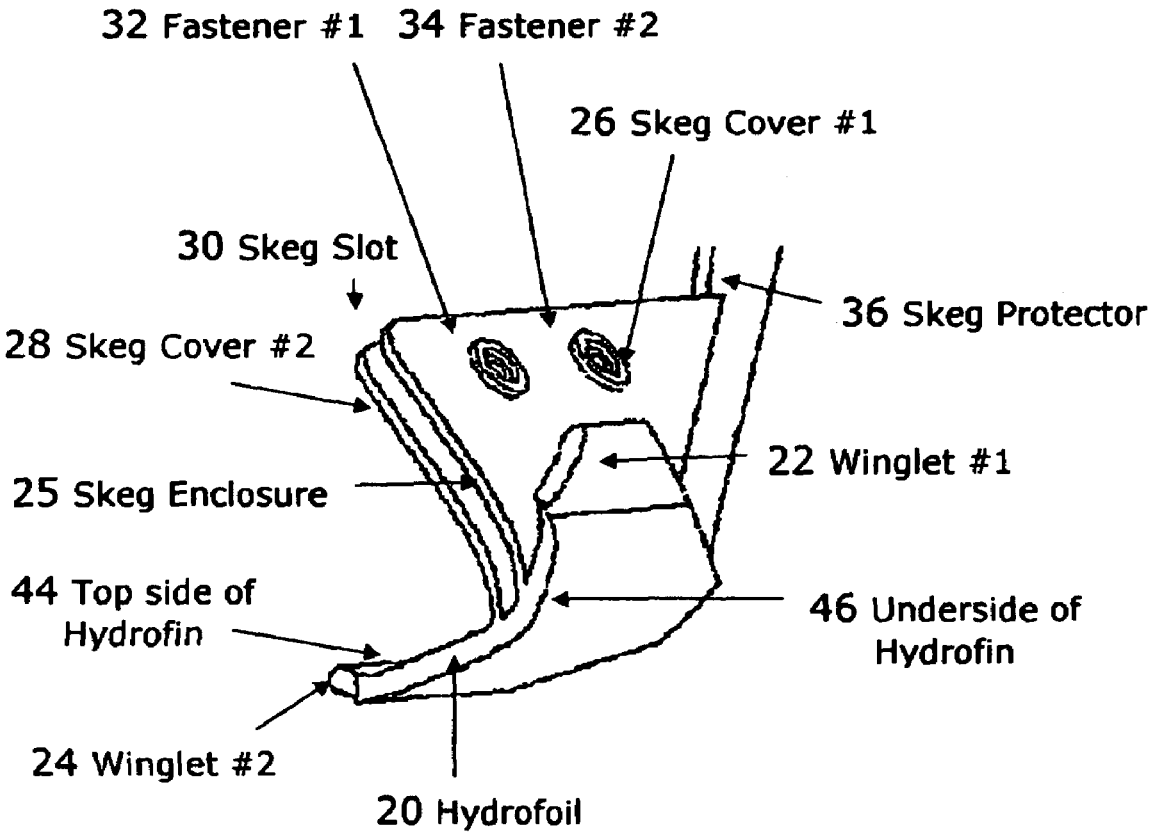
Figure 2. Hydrofoil with Skeg Enclosure

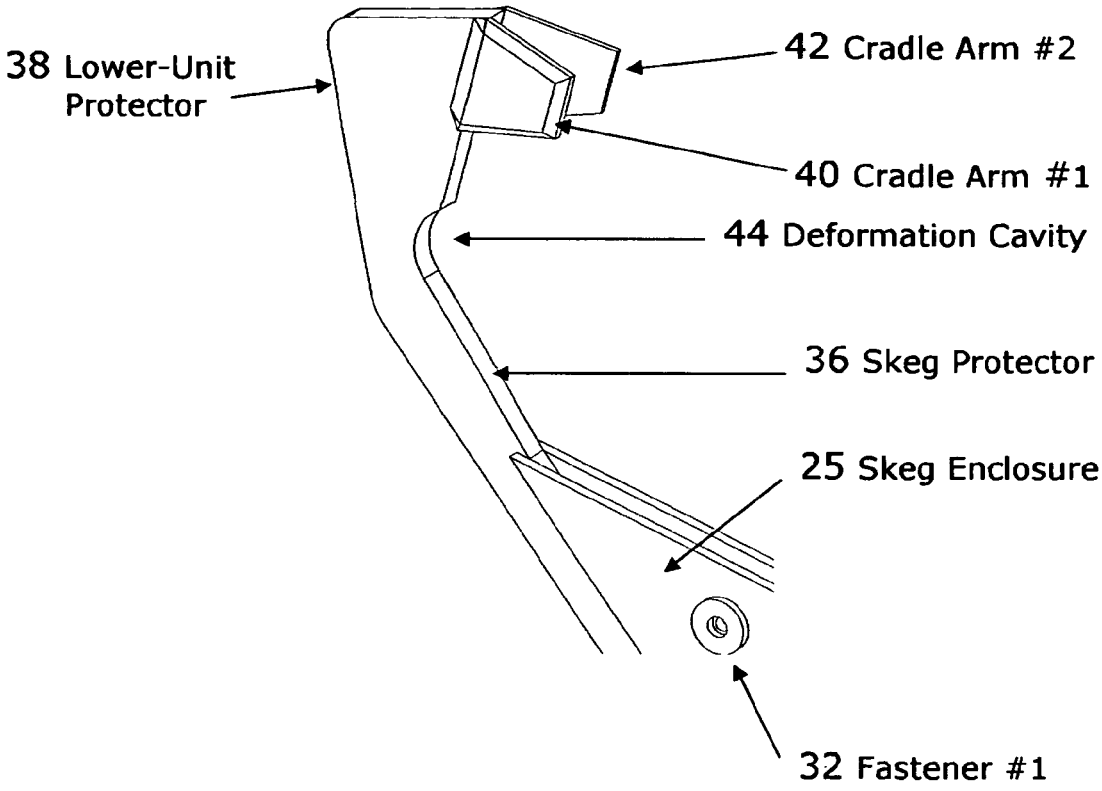
Figure 3. Skeg Enclosure with Skeg Protector and Lower-Unit Protector

INBOARD/OUTBOARD MOTOR PROTECTOR WITH UNDERWATER HYDROFOIL

BACKGROUND OF THE INVENTION a. Field of the Invention

The present invention generally pertains to marine propulsion device protection while a marine propulsion device is in operation, and more particularly to protection of a skeg, a propeller and a lower unit of an inboard/outboard motor in operation while improving the performance of an inboard/outboard motor.

b. Description of the Background

When an inboard/outboard motor is in operation, its lower unit component parts can easily be damaged by rocks, debris and other objects. Because such damage is expensive to repair, devices have been developed to protect the lower unit components of an inboard/outboard motor from damage. In particular, the skeg, the propeller and the lower unit of an inboard/outboard motor may each be protected from common forms of damage by devices well-known in the prior art.

Devices in the prior art that protect the skeg and propeller of an inboard/outboard motor from damage include a skeg enclosure, which tightly encloses part or all of the large flat sides of a skeg to protect it from damage. Such enclosures are commonly "one-size-fits-all" devices to protect most common skeg sizes and shapes. U.S. Pat. No. 5,018,997 (Guptill), which is specifically incorporated herein by reference for all that it discloses and teaches, discloses such a skeg enclosure made of stainless steel. However, Guptill does not teach any method of combining a skeg enclosure with any other device.

A common form of protection for both propellers and lower units utilizes a plate that is mounted near the propeller or lower unit to act as a debris deflector. The plate, in addition to deflecting debris from the propeller or lower unit, is also designed to absorb the force of any collision with rock or debris. If the force is large enough, the plate undergoes deformation itself to prevent deformation of the propeller or lower unit. The plate typically creates a drag on an inboard/outboard motor, reducing the efficiency of the inboard/outboard motor. Propeller protectors and lower-unit protectors in the prior art typically protect smaller inboard/outboard motors up to about 50 horsepower.

Other devices in the prior art for protecting an inboard/outboard motor include an elongated rigid bar that deflects debris and protects a skeg from damage, as well as a lower-unit protector that protects the lower unit of an inboard/outboard motor by deflecting some debris and absorbing damage from other debris. U.S. Pat. No. 6,503,110 (Lammli), which is specifically incorporated herein by reference for all that it discloses and teaches, discloses a lower-unit protector that uses fasteners to attach to a lower unit of an inboard/outboard motor. Lammli teaches that a rigid bar, which deflects debris and absorbs collision damage, may be combined with a reinforcement member to better absorb or deflect debris. Lammli further teaches the use of fasteners to attach a lower-unit protector to an inboard/outboard motor but does not teach a method of attaching a lower-unit protector to an inboard/outboard motor without fasteners. Lammli also does not teach any method of combining a lower-unit protector and a skeg enclosure into a single device.

One drawback of inboard/outboard motor protection devices is that use of such devices typically reduces the speed and efficiency of a boat and adversely affects the quality of the ride. One method of counteracting the effects of such devices is a hydrofoil, commonly attached above the lower unit and riding at the surface of the water during operation. A hydrofoil typically raises the inboard/outboard motor out of the water, which keeps the motor on an even plane, reduces drag on the boat from the surrounding water, improves the speed of the boat and allows the motor to move the boat faster while using less fuel. Hydrofoils in the prior art are designed in various shapes and are separate from motor protection devices. U.S. Pat. No. 6,095,875 (Allison), which is specifically incorporated herein by reference for all that it discloses and teaches, discloses a hydrofoil containing a plate that has plate tips downturned at a dihedral angle of between about 25° and about 45° with respect to the plate. However, Allison does not teach any method of combining a hydrofoil with a debris-protection device, nor does it teach that a hydrofoil can operate underwater.

Devices that protect a skeg, a propeller or a lower unit commonly protect only one or two of those three. Thus, simultaneous use of more than one device is typically required to protect a skeg, a propeller and a lower unit. Protection of a single inboard/outboard motor and counteracting the adverse effects of such protection may require both multiple inboard/outboard motor protection devices and a hydrofoil.

It would be advantageous to create a single inboard/outboard motor protector device for larger inboard/outboard motors (up to about 250 horsepower) that combines the functions of skeg protection, propeller protection and lower unit protection while minimizing the resulting drag. It would further be advantageous if such an inboard/outboard motor protector also contained a hydrofoil that operates underwater to improve the efficiency of an inboard/outboard motor and improve the speed and riding quality of a boat using an inboard/outboard motor.

SUMMARY OF THE INVENTION

The present invention overcomes the disadvantages and limitations of the prior art by providing a device that protects large inboard/outboard motors (up to about 250 horsepower) from damage and simultaneously provides an underwater hydrofoil that both helps prevent motor damage and is specifically designed to improve the efficiency of an inboard/outboard motor and the speed and ride of a boat using an inboard/outboard motor.

In one embodiment, an underwater hydrofoil, a skeg enclosure, a skeg protector and a lower-unit protector are combined into a single unit to protect the skeg, propeller and lower unit of an inboard/outboard motor while simultaneously improving the efficiency of an inboard/outboard motor and the speed and riding qualities of a boat using such a motor.

The present invention may therefore comprise a device comprising: a hydrofoil that operates underwater and contains at least one hydrofin with at least one curved side and at least one winglet with at least one beveled edge wherein the leading edge of said winglet has a downward angle of attack with respect to the horizontal plane of said hydrofoil, a skeg enclosure that protects or replaces the skeg of an inboard/outboard motor and consists of two skeg covers that form a slot to enclose said skeg of said inboard/outboard motor, where said skeg covers hold said skeg of said inboard/outboard motor in place by means of at least one non-protruding fastener, such as an Allen bolt, that connects said skeg covers to said skeg and have beveled, curved or raised surfaces designed to prevent protrusion of a fastener from said skeg covers, a skeg protector that consists of a first elongated rigid bar, and a lower-unit protector that consists of a second elongated rigid bar. The size of this device is proportional to the size of said inboard/outboard motor, and all parts of this device may be made of plastic, aluminum or a composite material.

The advantages of the present invention are protection of an inboard/outboard motor from damage, improved efficiency of an inboard/outboard motor, and improved speed and riding qualities of a boat using an inboard/outboard motor.

BRIEF DESCRIPTION OF THE DRAWINGS

In the drawings,

FIG. 1 is a perspective view of the various elements of the present invention.

FIG. 2 is an illustration of the lower section of one embodiment of the present invention, wherein a hydrofoil is connected to a skeg enclosure and a skeg protector.

FIG. 3 is an illustration of one embodiment of the present invention, wherein a skeg enclosure and skeg protector are connected to a lower-unit protector.

DETAILED DESCRIPTION OF THE INVENTION

The component parts of an inboard/outboard motor are often damaged by rocks, debris and other objects while the motor is in operation. Devices that protect an inboard/outboard motor from such damage typically reduce the efficiency of the motor by creating drag and by adding extra weight that the motor must move. Such devices may also cause the front of a boat to ride too high in the water for the motor to work at peak efficiency, a condition known as "plowing."

The present invention combines a hydrofoil, a skeg enclosure, a skeg protector and a lower-unit protector into a single device. FIG. 1 is a perspective view of the various elements of one embodiment of the present invention. A hydrofoil 20 that consists of a hydrofin 21 and winglets 22 and 24 is connected to a skeg enclosure 25 that consists of two skeg covers 26 and 28 and a skeg slot 30 between the skeg covers 26 and 28. Two fasteners 32 and 34 are provided to hold a skeg of an inboard/outboard motor in the skeg slot 30 between the skeg covers 26 and 28. The lower end of a skeg protector 36 is connected to the skeg enclosure 25, while the upper end of the skeg protector 36 is connected to a lower-unit protector 38 that attaches to an inboard/outboard motor by use of two cradle arms 40 and 42. All elements of the present invention must be made of plastic, aluminum or a composite material; elements made of metals other than aluminum may cause electrolysis in water.

The hydrofoil 20 is designed to improve inboard/outboard motor efficiency by operating underwater instead of at the surface. The curved underside of the hydrofin 21 has a larger surface area than the top side of the hydrofin 21. The front of the hydrofin 21 also points downward with respect to the horizontal plane of the hydrofin 21; in one embodiment of the present invention, the front of the hydrofin 21 has a downward angle of attack of about 5° with respect to the horizontal plane of the hydrofin 21. The larger underside surface area of the hydrofin 21 and the front tilt of the hydrofin 21 are inventive design aspects that help the hydrofoil 20 stay underwater, resist forces that may pull toward the surface, and protect the propeller of an inboard/outboard motor from damage. As the hydrofoil 20 stays underwater, the propeller of an inboard/outboard motor is stabilized with a slight downward pressure, allowing a boat motor to be trimmed higher, the bow of a boat to be lower, and less of the underside of a boat to touch the water. The drag on an inboard/outboard motor and on a boat is thus reduced, and the speed and riding qualities of a boat are improved.

One embodiment of the present invention has the hydrofin 21 and the winglets 22 and 24 manufactured in a single piece, while alternate embodiments may have the hydrofin 21 and the winglets 22 and 24 manufactured as separate pieces and attached to each other in a separate process to form a single piece. Each winglet 22 and 24 may have at least one beveled edge to reduce the size of the water vortex created by the hydrofin 21 around a motor and compress the water directed to the propeller of an inboard/outboard motor, creating a tunneling effect in the water. Alternative embodiments of the present invention may have the winglets 22 and 24 manufactured as mirror images of each other, while further embodiments may have two winglets that are not mirror images of each other or have a different number of winglets than two.

FIG. 2 is a closer view of the lower section of FIG. 1, picturing a hydrofin with a topside 60 and an underside 62 that has two winglets 22 and 24 attached to a skeg enclosure 25. The skeg enclosure 25 consists of two skeg covers 26 and 28 with a skeg slot 30 between them that contain two fasteners 32 and 34. A skeg of an inboard/outboard motor is inserted into the skeg slot 30 between the skeg covers 26 and 28 and held in the skeg enclosure 25 by means of fasteners 32 and 34 that fit into the fastener holes. The skeg enclosure 25 may also serve to replace or partly replace a damaged skeg. A skeg protector 36, consisting of an elongated rigid bar, along with the skeg covers 26 and 28, absorb impact from collisions with debris and also protect a skeg and propeller from damage while an inboard/outboard motor is in operation.

The present invention is utilized by drilling at least one hole entirely through a skeg so as to line up holes in the skeg with the fastener holes when the skeg is inserted into the skeg slot 30 between the skeg covers 26 and 28. Optimum embodiments of the present invention require drilling of two parallel holes in the skeg a short distance apart at right angles to the plane of the skeg covers 26 and 28 to accommodate two fasteners 32 and 34 that hold the skeg firmly in the skeg slot 30 between the skeg covers 26 and 28. In alternative embodiments of the present invention, those surfaces of the skeg covers 26 and 28 that do not touch a skeg when a skeg is in the skeg slot 30 are beveled, curved or raised to keep the fasteners 32 and 34 in the fastener holes from wiggling loose. Optimum embodiments of the present invention further utilize fasteners 32 and 34 that do not protrude from those surfaces of the skeg covers 26 and 28 that do not touch a skeg when a skeg is in the skeg slot 30. Non-protruding fasteners reduce drag on a boat and improve efficiency) of an inboard/outboard motor. Non-protruding fasteners must utilize nuts and bolts, such as Allen bolts, that can withstand pressure from surrounding water. Screws are not appropriate for non-protruding fasteners, as pressure from surrounding water may cause screw threads to become stripped if the present invention is made of aluminum.

One embodiment of the present invention has the skeg enclosure 25, skeg protector 36, hydrofin 21 and winglets 22 and 24 manufactured in a single piece, while other embodiments may have the skeg enclosure 25, skeg protector 36, hydrofin 21 and winglets 22 and 24 manufactured as separate pieces and combined into a single piece as a separate process.

FIG. 3 is a closer view of the upper section of FIG. 1, picturing a skeg enclosure 25 (and fastener #1 32) and a skeg protector 36 that are connected to a lower-unit protector 38 that attaches to an inboard/outboard motor by use of two cradle arms 40 and 42. The lower-unit protector 38 protects the lower unit of an inboard/outboard motor from small debris and is a rigid elongated bar made of plastic, aluminum or a composite material. In case of impact between the lower-unit protector 38 and a large object, the lower-unit protector 38 may undergo deformation and change its shape slightly. The lower-unit protector 38 may be angled to create a deformation cavity 44. The deformation cavity 44 represents the distance that the lower-unit protector 38 may be moved or deformed by a collision without damaging an inboard/outboard motor.

The cradle arms 40 and 42 work together to create a clamp that closes tightly on the lower unit of an inboard/outboard motor and helps to keep the present invention attached to an inboard/outboard motor. Though the present invention does not require fasteners when using the cradle arms 40 and 42, an industrial-duty two-sided adhesive may be applied between the cradle arms 40 and 42 to ensure secure attachment of the present invention to an inboard/outboard motor. The elements of the invention that are shown in FIG. 3 may be adjusted in size to accommodate different physical sizes of inboard/outboard motors; the larger the motor, the larger the present invention should be.

As a boat using an inboard/outboard motor moves, a skeg and propeller are protected from damage by the skeg enclosure 25 and skeg protector 36. The lower unit of an inboard/outboard motor is prevented from damage by the lower-unit protector 38 that remains attached to the outboard motor by the cradle arms 40 and 42. The efficiency of an inboard/outboard motor and the speed of a boat are improved by underwater hydrofoils connected to the lower end of the skeg enclosure 25, as illustrated in FIGS. 1 and 2.

The present invention therefore provides a device that protects the lower unit, the propeller, and the skeg of an inboard/outboard motor from damage while simultaneously providing an underwater hydrofoil that is designed to improve the efficiency of an inboard/outboard motor and the speed and ride of a boat.

It should be noted that optimal use of the present invention requires operators of an inboard/outboard motor to exercise common sense and to utilize basic water safety principles, including common methods of collision avoidance and use of a personal flotation device. Though the present invention should withstand a collision with a small object at a speed up to 10 knots without damaging an inboard/outboard motor, both the present invention and an inboard/outboard motor may be destroyed by collision with a very large object, or by collision with a small object at speeds above 10 knots.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as suited to the particular use contemplated. It is intended that the appended claims be construed to include other alternative embodiments of the invention, except insofar as limited by the prior art.

What is claimed is:

1. A device to improve the efficiency of an inboard/outboard motor of up to 250 horsepower, protect a propeller of said inboard/outboard motor from damage, protect a skeg of said inboard/outboard motor from damage and protect a lower unit of said inboard/outboard motor from damage, comprising:

a hydrofoil that operates underwater and contains at least one hydrofin with at least one curved side and at least one winglet with at least one beveled edge;

a skeg enclosure that protects or replaces the skeg of an inboard/outboard motor;

a skeg protector consisting of a first elongated rigid bar; and, a lower-unit protector consisting of a second elongated rigid bar.

2. The device of claim 1 wherein the leading edge of said winglet has a downward angle of attack with respect to the horizontal plane of said hydrofoil.

3. The device of claim 1 wherein said skeg enclosure consists of two skeg covers that form a slot to enclose said skeg of said inboard/outboard motor.

4. The device of claim 3 wherein said skeg covers hold said skeg of said inboard/outboard motor in place b) means of at least one non-protruding fastener, such as an Allen bolt, that connects said skeg covers to said skeg.

5. The device of claim 4 wherein said skeg covers have beveled, curved or raised surfaces designed to prevent protrusion of a fastener from said skeg covers.

6. The device of claim 1 wherein said lower-unit protector is attached to a clamp consisting of at least one cradle arm that holds said lower-unit protector in place.

7. The device of claim 6 wherein said clamp attaches to said lower unit of said inboard/outboard motor without using fasteners.

8. The device of claim 1 wherein said lower-unit protector is angled to create a deformation cavity that allows deformation of a portion of said lower-unit protector upon impact without said portion of said lower-unit protector touching said lower unit of said inboard/outboard motor.

9. The device of claim 1 wherein the size of said device is proportional to size of said inboard/outboard motor.

10. The device of claim 1 wherein said hydrofoil, said skeg enclosure, said skeg protector and said lower-unit protector are each made of plastic, aluminum or a composite material.

* * * * *